United States Patent [19]

Krøyer et al.

[11] Patent Number: 4,494,278

[45] Date of Patent: Jan. 22, 1985

[54] APPARATUS FOR THE PRODUCTION OF A FIBROUS WEB

[75] Inventors: Karl K. K. Krøyer, Le Schuykill, 19, Blvd. de Suisse, Apt. No. 1, Bloc B, 3. etage, Monte Carlo, Monaco; Torben Rasmussen, Brondby Strand, Denmark

[73] Assignee: Karl Kristian Kobs Krøyer, Monte Carlo, Monaco

[21] Appl. No.: 356,477

[22] Filed: Mar. 9, 1982

Related U.S. Application Data

[63] Continuation of Ser. No. 211,856, Dec. 1, 1980, abandoned, which is a continuation of Ser. No. 958,482, Nov. 7, 1978, abandoned.

[30] Foreign Application Priority Data

Nov. 8, 1977 [DK] Denmark ..... 4956/77

[51] Int. Cl.[3] ..... D01G 25/00; D04H 1/00

[52] U.S. Cl. ..... 19/304; 264/518; 425/83.1

[58] Field of Search ..... 19/304; 425/83.1; 264/518

[56] References Cited

U.S. PATENT DOCUMENTS

| | | | |
|---|---|---|---|
| 3,576,349 | 4/1971 | Mark | 19/304 X |
| 4,014,635 | 3/1977 | Kroyer | 425/83 1 X |
| 4,060,360 | 11/1977 | Tapp | 19/304 |
| 4,112,549 | 9/1978 | Min et al. | 19/304 |
| 4,144,619 | 3/1979 | White et al. | 19/304 |
| 4,157,724 | 6/1979 | Persson | 19/304 X |

FOREIGN PATENT DOCUMENTS

| | | | |
|---|---|---|---|
| 422226 | 1/1935 | United Kingdom | 19/304 |
| 1207556 | 10/1970 | United Kingdom | 19/304 |
| 1499687 | 2/1978 | United Kingdom | 19/304 |

*Primary Examiner*—Robert R. Mackey

*Attorney, Agent, or Firm*—Watson, Cole, Grindle & Watson

[57] ABSTRACT

An apparatus for the production of a fibrous web comprising a fiber distributor with a housing having an inlet for dry defibrated fibrous material and a perforated bottom wall, and at least two closely spaced rows of stirrers, each comprising impellers which are rotatably mounted within the housing, an air-permeable forming wire, a mechanism for advancing the wire below the bottom wall of said fiber distributor and a suction box mounted below the rows of stirrers and the forming wire.

7 Claims, 5 Drawing Figures

APPARATUS FOR THE PRODUCTION OF A FIBROUS WEB

CROSS REFERENCE TO RELATED APPLICATION

This application is a continuation application of application Ser. No. 211,856, filed Dec. 1, 1980, now abandoned, which was a continuation application of application Ser. No. 958,482, filed Nov. 7, 1978, now abandoned.

BACKGROUND OF THE INVENTION

This invention relates to an apparatus for the manufacture of a fibrous web, which apparatus includes a fiber distributor comprising a housing having inlet means for a dry, defibrated fibrous material and a perforated bottom wall, and stirring means including impellers which are rotatably mounted within the housing; an air-permeable forming wire; means for advancing the wire in a path located a short distance below the bottom wall of the fiber distributor; and a suction box mounted below the fiber distributor and the forming wire.

A prior art apparatus for the production of a fibrous web comprises several fiber distributors and corresponding suction boxes mounted at intervals along a forming wire. When using such an apparatus, the thickness of the fibrous web formed is increased stepwise. However, fibrous products which are made stepwise tend to delaminate because of an insufficient integration between adjacent fiber layers. Consequently, a relatively large amount of binder is required to obtain a desired strength of the final fibrous product. Furthermore, this prior art method of manufacturing fibrous products presents serious problems when light weight products are desired. In that case, the fibrous layer initially deposited on the forming wire is very thin and consequently is easily damaged when passing through the zone between two adjacent fiber distributors, i.e., because it is merely loose on the wire within such zone. Furthermore, in case of very thin products in which the fibers are not entangled in one another, the fibers tend to form groups of fibers during the passage between two fiber distributors and, therefore, non-uniform products are obtained. This problem becomes aggravated when the speed of the forming wire is increased to increase the production rate.

In order to prevent the introduction of false air at the front and rear edges of the fiber distributors and consequently a non-uniform distribution of fibers in the fiber layers formed, driven rollers contacting the forming wire or the fiber layer deposited thereon have been mounted at each fiber distributor.

The use of such rollers presents the drawback that the fibers, unless their moisture content is maintained within narrow limits, tend to accumulate on the surfaces of the rollers and form layers thereon. Furthermore, such rollers tend to increase the tendency of delamination of the fibrous product formed because they smooth out the surface of the fiber layer formed and consequently prevent fiber ends extending from the layer from being entangled with fibers of a fiber layer subsequently applied.

The object of the present invention is to provide an apparatus which is capable of producing an improved uniform fibrous web. A further object is to produce a strongly coherent fibrous product at a high production rate

SUMMARY OF THE INVENTION

According to the present invention, a fibrous web-forming apparatus is provided which includes a suction box, a foraminous forming wire which is positioned to pass thereover, and a fiber distributor positioned above the foraminous forming wire as it passes over the suction box, the fiber distributor including one or more housings which together provide at least two closely spaced rows of stirring members, each row extending transversely of the foraminous forming wire. The fibers passing downwardly through the fiber distributor and on to the foraminous forming wire as it passes over the suction box will provide a fibrous product of gradually increasing thickness, and thus of a coherent and highly integrated construction.

In a preferred embodiment, the fiber distributor will comprise a single housing which has a perforated bottom wall facing the foraminous forming wire, at least two rows of stirring devices extending transversely of the housing, each stirring device including an impeller rotatable in a plane parallel to the perforated bottom wall, vertically extending partition means located between adjacent rows of stirring devices, overhang elements extending in opposite directions away from the top edge of each partition means, and discharge means for discharging an air stream containing dry, defibrated material downwardly toward the top edge of alternate partition means. One or more motors operate the stirring devices such that the impellers of the stirring devices of each row are caused to rotate in the same direction, but oppositely to the direction of rotation of the adjacent row(s). The partition means can be in the form of a solid plate or closely spaced wires or rods positioned one above the other.

Further features and advantages of the present invention will be understood by reference to the attached drawings taken in conjunction with the ensuing discussion.

DETAILED DESCRIPTION OF THE PREFERRED EMBODIMENTS

Figure 1:
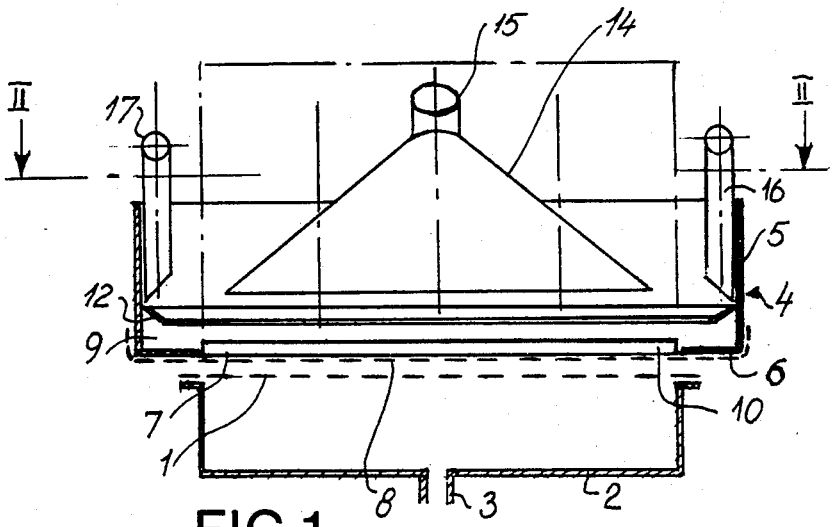
FIG. 1 shows a schematic vertical sectional view of an apparatus for producing a fibrous web according to one embodiment of the present invention, the view being taken along line I—I of FIG. 2.
Figure 2:
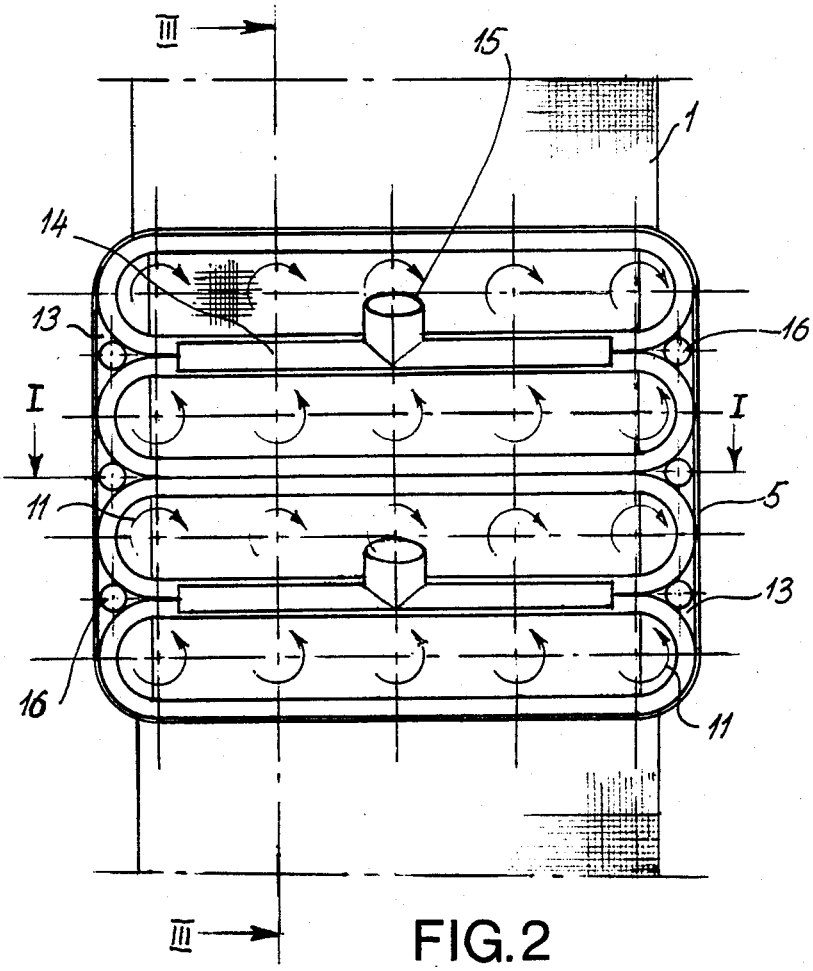
FIG. 2 shows a schematic horizontal sectional view of the inventive apparatus as seen along line II—II of FIG. 1.
Figure 3:
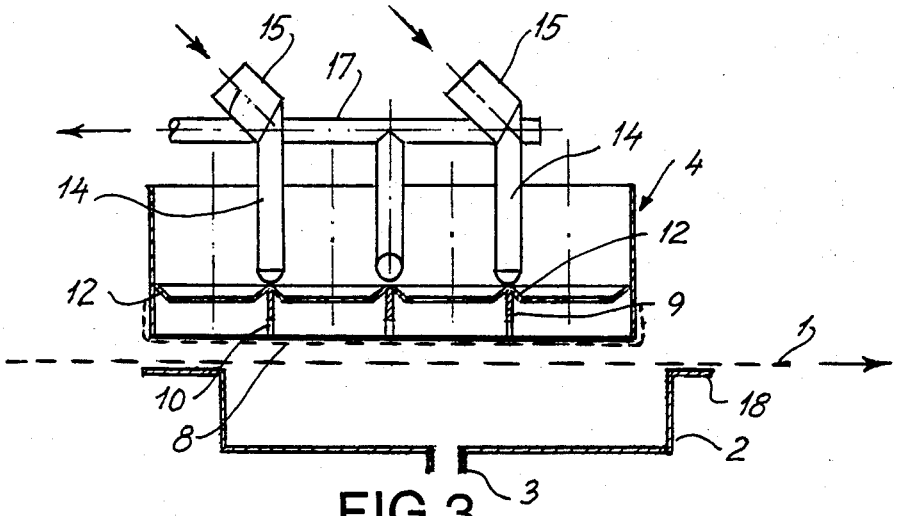
FIG. 3 shows a schematic vertical sectional view of the inventive apparatus as seen along line III—III of FIG. 2.

A preferred apparatus for producing a fibrous web according to the present invention is schematically shown in FIGS. 1–3. It includes a fiber distributor 4, a suction box 2 and an endless foraminous forming wire 1 passing therebetween, the endless forming wire consisting, for example, of a 24 mesh net constructed using bronze wires. The forming wire 1 is driven by a suitable means (not shown) such that it will continuously pass between the distributor 4 and the suction box 2. As can be appreciated from a review of FIG. 3, the suction box will be somewhat offet from the fiber distributor in the direction of movement of the forming wire 1.

The suction box 2 includes at its front and rear edges (considering the direction that the forming wire 1 passes thereover) horizontal flanges 18, and by way of a suction pipe 3 is connected to a fan (not shown) for the creation of a vacuum therein.

The fiber distributor 4 includes a box-like housing 5, the corners of which are rounded, the bottom thereof comprising flanges 6 which extend inwardly a short distance from the side walls (not labelled) so as to leave an opening 7 in the bottom of the housing 5. A net 8, which is connected to outer portions of the side walls of the housing by suitable means (not shown), is stretched over this opening 7.

Inside the housing 5 are mounted three partition means in the form of imperforate walls 9 which extend transversely of the housing (with respect to the passage of the forming wire 1 thereunder) and are spaced apart in the longitudinal direction of the housing to create four separate sections therein. These partition walls 9 extend upwardly in the housing only about $\frac{1}{3}$ of its total height, and the bottoms thereof do not extend all the way down to the opening 7, but instead leave spacings 10 therebetween, thus creating a distance measurable in centimeters between their bottoms and the net 8.

Positioned in each of the four sections of the housing 5 are a row of five stirring means 20 (depicted in FIGS. 4–5), each of which includes a vertically oriented drive shaft 21 and one or more impellers 22, the impellers 22 being rotatable in a plane located a small distance above, and essentially parallel to, the net 8. Drive means 23 are attached to each stirring means so that the impellers thereof will rotate in the directions as shown in FIG. 2, i.e., the same direction in each row but oppositely to the direction of impeller rotation in the adjacent row(s).

Also located in the distributor 4 are inclined overhang elements 12 which extend in opposite directions and downwardly from the top edge of each partition wall 9 to separate the zones in which the impellers of the stirring means are moving from the zones located thereabove. The opposite transverse ends of elements 12 within each section of the distributor 4 are connected by an arcuate portion 12'. The openings left between adjacent arcuate portions 12' are closed by generally triangularly-shaped connector plates 13 which are also attached to the transverse sides of the housing 5.

The distributor 4 further includes two fiber discharge means which discharge an air stream containing dry defibrated fibrous material downwardly toward the top edges of alternate partition walls 9, each fiber discharge means including a fish tail-shaped hood 14 whose longitudinal dimension extends transversely of the housing 5. Connected to each hood 14 is an inlet conduit 15.

Located in the upper part of the housing 5 at its transverse sides are suction pipes 16. Each suction pipe 16 has a lower end which is located just above a respective generally triangularly-shaped connector plate 13 and functions, via connection to pipes 17 which are respectively mounted on the opposite sides of the housing 5, to remove any fibrous material which accumulates on the upper sides of the generally triangularly-shaped connector plates and recycle such material to the defibrator (not shown) which is connected to the inlet conduits 15.

The inventive apparatus operates as follows. Defibrated fibrous material in an air suspension is fed by inlet conduits 15 to the hoods 14 so as to be distributed over the full width of the housing 5 above the partition walls 9. Due in part to the suction generated by suction box 2 and in part by gravity, the fibrous material moves down through one of the four sections that are formed by the partition walls 9. In these sections, the material is subjected to the influence of the four rows of stirring means and is caused to move along the net 8, a partially coherent sausage-shaped body being formed within each section. During the passage along the partition walls 9, part of the material passes from one section to the adjacent section through the openings 10.

During the movement of the fibrous material along the net 8 and while under the influence of the suction from the suction box 2, the loose fibers pass through the net 8 and are then brought into contact with the forming wire 1 on which they are deposited. Agglomerations, if any, of free fibers are broken down and the separate fibers thus formed pass through the net and are caught by the forming wire 1. Thus, a fiber layer is formed in the forming wire 1.

Fiber lumps, if any, which cannot be broken down by this treatment tend to move upwardly in the housing 5 and subsequently pass into the zone located above the inclined overhangs 12. Such fiber lumps tend to accumulate at the transverse side walls of the housing 5 and in particular in the zones above the plates 13. Due to the provision of suction pipes 16 in this zone, such fiber lumps can be easily removed and recycled for defibration. The removal of fiber lumps is effected in a manner such that the desired fiber movement in the lower portions of the four sections is not adversely affected. It is pointed out that the direction of rotation of the stirrers in adjacent sections of the housing 5 is adjusted so that the fibrous materials in proximity to the opposite sides of a partition wall move in the same direction as indicated by the arrows 11.

Figure 4:
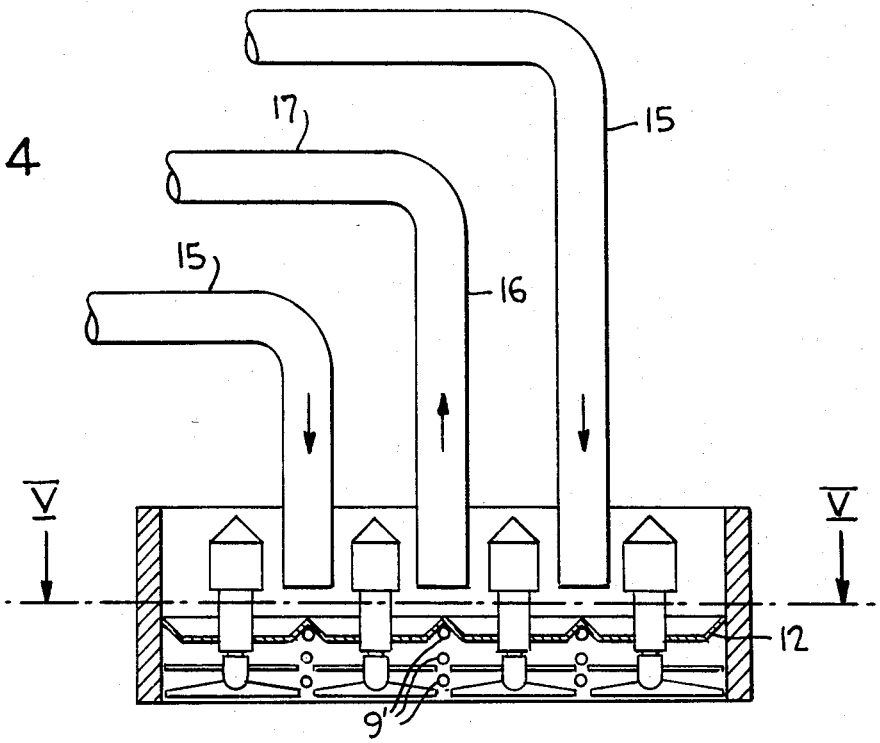
FIG. 4 shows a schematic vertical sectional view of an alternative construction of fiber distributor useful in the inventive apparatus.
Figure 5:
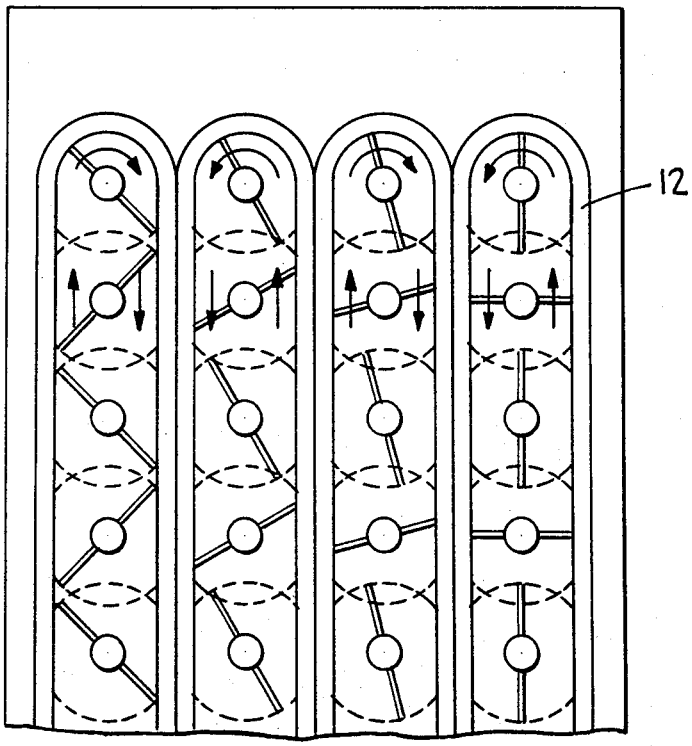
FIG. 5 shows a schematical horizontal sectional view of the fiber distributor as seen along line V—V of FIG. 4.

Turning now to the alternative embodiment of fiber distributor useful in the inventive apparatus as shown in FIGS. 4 and 5, it can be seen that the partition means creating the four sections within the housing, instead of comprising imperforate walls, can comprise closely spaced rods 9' which extend from one transverse side of the housing 5 to the other.

Because the fibrous product produced by the apparatus of the present invention is integrated in construction and resistant to delamination, it is necessary to provide sufficient binder only to maintain the integrated fibers in place. The result is that the consumption of binder, which represents a significant expenditure in the manufacture of fibrous products by the dry laying method, can be significantly reduced. By using a fiber distributor containing, say, five rows of stirring means, the consumption of binder can be reduced by up to 50% by weight.

It is assumed that a major reason for obtaining a strongly coherent fibrous product by using the apparatus of the invention is that the fibrous product during its formation is constantly under the influence of the suction from the suction box. Therefore, it is unnecessary to roll the fiber layer formed by one row of stirring means before further fibers are applied thereon during the passage below the subsequent row of stirring means. Such roller treatment of the fibrous product produces a smooth surface and consequently the coherence between the fibers of two adjacent layers is reduced.

By providing several closely spaced rows of stirring means, it is also possible to reduce the zone in which false air may be introduced because the length of this zone is reduced when several rows of stirring means are mounted above the same suction box. Therefore, the use of rollers at the front and rear edges of the fiber distributor may be avoided while obtaining a fibrous product having a uniform fiber distribution in the cross machine direction.

A further advantage of the apparatus of the invention is that it permits the use of a significantly shorter forming wire than the wires used in the prior art apparatus. The use of closely spaced rows of stirring means also presents the significant advantage that a plant based on the use of apparatuses of the invention requires less space and smaller buildings than a plant based on the use of separate fiber distributors.

Furthermore, the initial costs are reduced because all the stirring means can be driven by one motor, whereas it has been found necessary to use one motor for each fiber distributor in the prior art apparatus.

It should be noted that the overhang elements attached to the upper edges of the partition means may provide therewith a T-shaped cross section or may extend downwardly therefrom as with a roof. When the partition means are in the form of closely spaced rods and the overhang elements provide therewith a T-shaped cross section, a further advantage is obtained, namely that air streams may pass through the zone below the horizontal portions of the T-shaped divider.

It should be pointed out that the overhang elements also may be curved or be in the form of a V and that the main objective of providing these elements extending outwardly from the partition walls is to preserve the sausage-shaped bodies which move around along the bottom wall and which during such movement are subjected to abrasion so as to release individual fibers which, after having passed through the bottom wall, are caused to be deposited on the forming wire under the influence of the suction from the suction box.

The fibrous material is preferably supplied through inlet conduits which, e.g., terminate above the partition walls so as to make it possible to supply fibrous material to two adjacent rows of stirring means. However, in many cases it is preferred to provide a separate inlet conduit for each zone between the partition walls. In this manner, it is possible to build up fibrous products in which the fiber layers formed by different rows of stirring means are of different compositions. When using such an apparatus, fibrous products, e.g., may be prepared in which the central layer or layers are formed of cheaper fibers, such as fibers of waste paper, than the surface layers. By separately supplying different mixtures of fibrous material and binder, for example, in powder form, it is possible to obtain a higher binder concentration at the surfaces of the fibrous product than in the central layer or layers. Furthermore, different types of binders may be introduced in the various layers. For example, binders which are incompatible and which are activated in different ways may be used. Examples of such binders are thermo-curing acrylic binders and binders prepared from starches. A further possibility is to vary the amount of a dye, if any, which is supplied together with the fibrous material and the binder, if any.

Even when forming fibrous products consisting of layers of different compositions, a satisfactory cohesion between the layers is obtained because no layer is subjected to any treatment before a further layer is deposited thereon.

The above-mentioned embodiment of the apparatus of the invention is suitable for the production of waste fibers, such as news print papers. By incorporating news print fibers between surface layers of virgin fibers, a difficult treatment of news print material for removing printing inks therefrom can be avoided.

The above-mentioned separate inlet conduits may be connected to separate defibrators. However, it is sufficient to use only one defibrator of the hammer mill type, this defibrator being provided with two inlet openings and two discharge conduits because it has been found that if such a defribrator is fed with two materials, the defibrated materials are admixed only to a low degree.

The inlet conduits for fibrous material and binder, if any, are preferably of such a type that the discharge openings thereof can be adjusted relative to the bottom wall of the fiber distributor.

The bottom wall of the fiber distributor may consist of a plane perforated plate. However, such a plate is less satisfactory than a net, e.g., a woven net, because the abrasive effect which is produced when the fibrous material is subjected to the influence of the stirring means is less with a perforated plate than a net.

In order to prevent the fibers from accumulating at the crossing points in a woven net and the formation of fiber lumps, it is preferred to use nets in which the crossing wires are fixed relative to one another.

When using a metal wire net, such a fixation is obtainable by using tin-plated wires and by heating the net to a temperature sufficiently high to melt the tin-plating material.

When the wires subsequently are cooled, they become fixed relative to one another.

Examples of suitable metal wire nets are bronze nets, copper nets, brass nets, steel wire nets, nets of stainless steel wires and nets of electroplated steel wires. Also nets which have been treated with a binder, such as epoxy binders, to fix the net in its crossing points are suitable.

When using stirring means rotating about an axis perpendicular to the net, it may be desirable to use varying mesh sizes. Thus, it may be desirable to use a net wherein that part of the net which is located below the axis to rotation at which the relative speed is low, has a smaller mesh size than that portion of the net which is swept by the ends of the impellers.

The net may be mounted in stretched condition on the lower portion of the distributor housing by means of attachment means located on the exterior side of the housing. Alternatively, the net may be attached to the frame of the apparatus in a manner such that it is maintained in stretched condition shortly below the bottom of the distributor housing. Several interconnected distributor housings may be mounted above such a stretched net.

In order to avoid loss of fibers and/or binder passing through the forming wire, the suction box is preferably connected with a suction pump or source of vaccum in a manner such as to generate a stream of air through the fibrous product formed and to filter the air. This can be accomplished by connecting the suction box with an upwardly open compartment and by passing the final product above the compartment while removing air from the zone above the compartment. The suction box may also be connected with a compartment which is open at its bottom and which is mounted above the path of the fibrous product formed and by removing air from the zone below the path of the fibrous product.

In order to remove fiber lumps or accumulated fibers which are formed in the fiber distributor, a discharge pipe may be mounted in the zone between adjacent rows of stirrers. In this manner lumps of fibers or accumulations of fibers may be removed from the fiber distributor without adversely affecting the distribution pattern of the fibers which are discharged through the bottom of the fiber distributor.

Furthermore, it is preferable in order to obtain a fiber web having a uniform fiber concentration to close the bottom of the housing in the zones which are adjacent to the side walls of the fiber distributor.

In order to separate the zone in which fibers are passing through the bottom of the fiber distributor from the zone in which fibrous material is introduced and fiber lumps or accumulations of fibers are removed and thus to avoid interference with the fiber distribution, as inclined wall is preferably mounted in the zone above the upper edges of the impellers, the inclined wall extending all the way around and into the zones in which the impellers are moving. Thus, the inclined walls extend from the upper edges of the low partition walls. In such an embodiment of the apparatus, the inlet conduits for the fibrous material terminate in the zone above the low partition wall.

By combining six fiber distributors, each comprising one row of stirring means, and mounting such fiber distributors above a forming wire having a width of 2.5 meters, an increase of capacity of from about 250 kg per meter forming wire per hour to about 500 kg per meter forming wire per hour has been obtained in connection with the specific fiber types Various obvious modifications in the invention as described above can be achieved and still fall within the scope of the appended claims.

We claim:

1. An apparatus for producing a uniform and strongly adherent air-laid fibrous web, said apparatus comprising a fiber distributor, a suction box positioned below said fiber distributor and a movable foraminous forming wire located therebetween, said fiber distributor including a housing which has a perforated bottomwall which faces said movable foraminous forming wire, at least two rows of stirring means positioned in said housing, each row extending transversely of said housing, and each stirring means including an impeller which is rotatable in a plane parallel to the perforated bottom wall of said housing, means for rotating the impellers of the stirring means in each row in the same direction but oppositely to the direction of the rotation of the impellers in the adjacent row(s), at least one partition means extending transversely across said housing, a separate partition means acting to separate adjacent rows of stirring means, each partition means including a vertically-extending portion which has a bottom edge which is spaced apart from the perforated bottom wall of said housing and a top edge, overhang elements which extend in opposite directions away from the top edge of each partition means and towards the adjacent rows of stirring means, and at least one discharge means for discharging an air stream containing dry, defibrated fibrous material downwardly toward the top edge of a partition means, a separate discharge means being associated with alternate partition means, each discharge means acting to supply the dry, defibrated material to zones on each side of the associated partition means such that it is stirred, then spread in a sausage-shaped configuration on the perforated bottom wall therebelow, and then deposited on the foraminous forming wire therebelow, the overhang elements of the partition means acting to prevent dry, defibrated material from being stirred upwardly thereabove.

2. An apparatus as defined in claim 1 wherein the vertically-extending portion of each partition means comprises an imperforate wall.

3. An apparatus as defined in claim 1 wherein the vertically-extending portion of each partition means comprises a number of closely spaced rods which extend from one side of said housing to the opposite side.

4. An apparatus as defined in claim 1 wherein each discharge means comprises a hood which has a fish tail shape, the longitudinal dimension of the hood extending transversely across said housing.

5. An apparatus as defined in claim 1 wherein the overhang elements of adjacent partition means are connected by arcuate end sections.

6. An apparatus as defined in claim 5 wherein generally triangularly-shaped connector plates extend between said arcuate end sections and the adjacent trransverse sides of said housing.

7. An apparatus as defined in claim 6 wherein suction pipes extend into said housing to remove any fibrous material which accumulates on the upper side of each said generally triangularly-shaped connector plate.

* * * * *